US006527314B2

(12) United States Patent
Brown

(10) Patent No.: US 6,527,314 B2
(45) Date of Patent: Mar. 4, 2003

(54) CLUTCH HANDLE

(75) Inventor: Peter Edward Brown, Shropshire (GB)

(73) Assignee: Jackson Corporation, Los Angeles, CA (US)

( * ) Notice: Subject to any disclaimer, the term of this patent is extended or adjusted under 35 U.S.C. 154(b) by 14 days.

(21) Appl. No.: 09/789,278

(22) Filed: Feb. 20, 2001

(65) Prior Publication Data

US 2002/0113445 A1 Aug. 22, 2002

(51) Int. Cl.[7] ..... E05B 13/00

(52) U.S. Cl. ..... 292/336.3; 70/422; 70/223; 70/189

(58) Field of Search ..... 70/422, 223, 189, 70/473; 292/347, 348, 358, 359, 336.3

(56) References Cited

U.S. PATENT DOCUMENTS

| | | | | |
|---|---|---|---|---|
| 1,910,125 A | | 5/1933 | Root | |
| 2,273,632 A | | 2/1942 | Floraday | |
| 2,469,601 A | | 5/1949 | Lee | |
| 3,314,708 A | | 4/1967 | Welch | |
| 4,655,059 A | | 4/1987 | Best et al. | |
| 4,679,420 A | | 7/1987 | Yang | |
| 4,773,240 A | | 9/1988 | Foshee | |
| 4,941,697 A | | 7/1990 | Fan | |
| 5,010,755 A | | 4/1991 | Best | |
| 5,040,652 A | | 8/1991 | Fish et al. | |
| 5,335,950 A | | 8/1994 | Mirshafiee et al. | |
| 5,516,161 A | | 5/1996 | Mader et al. | |
| 5,617,749 A | | 4/1997 | Park | |
| 5,651,280 A | | 7/1997 | Park | |
| 5,730,014 A | | 3/1998 | Berger et al. | |
| 5,787,743 A | | 8/1998 | Weigard | |
| 5,787,744 A | * | 8/1998 | Berger et al. | 292/350 |
| 5,868,018 A | * | 2/1999 | Kang | 70/149 |
| 5,904,232 A | * | 5/1999 | Shen | 192/69.62 |
| 5,927,777 A | * | 7/1999 | Kuo et al. | 292/358 |
| 5,934,117 A | * | 8/1999 | Shen | 70/149 |
| 5,992,189 A | * | 11/1999 | McCaa | 292/336.3 |
| 6,021,654 A | * | 2/2000 | McCaa | 292/336.3 |
| 6,041,630 A | * | 3/2000 | Shen | 70/149 |
| 6,189,351 B1 | * | 2/2001 | Eagan et al. | 292/DIG. 27 |

* cited by examiner

*Primary Examiner*—J. J. Swann
*Assistant Examiner*—Matthew E. Rodgers
(74) *Attorney, Agent, or Firm*—Sonnenschein, Nath & Rosenthal

(57) ABSTRACT

Clutch handle apparatus for opening doors and the like includes a torque limiting clutch subassembly which selectively disengages the handle from a spindle to prevent damage. The clutch subassembly includes a slip clutch removably coupled to a spindle pin allowing corotation of the handle and the spindle below the application of a predetermined torque, and free rotation of the handle with respect to the spindle by uncoupling the pin and the slip clutch at and above the application of a predetermined of torque to the handle.

16 Claims, 3 Drawing Sheets

CLUTCH HANDLE

BACKGROUND OF THE INVENTION

The present invention is directed to apparatus for opening and closing doors, windows and the like such as a handle or lever for applying torque to door opening mechanisms. The handle includes a torque-limiting clutch subassembly which disengages the handle from the door opening mechanism at and above a predetermined torque.

Handles or levers for applying torque to door opening mechanisms to enable opening or closing a door are well known. However, excess torque can damage the handle, the door and/or the door opening mechanism, for example when excessive force is applied to the handle when the door opening mechanism is in a locked or secured position. Similarly, even when the door opening mechanism is unlocked, excess torque may damage the handle, the door and/or the door opening mechanism.

A variety of breakaway handle devices have attempted to solve these problems. For example, U.S. Pat. No. 1,910,125 includes a handle barrel which receives a longitudinally slidable sleeve. In operation, if excess torque is applied to the handle, the sleeve moves to a disengaged position where no torque is transmitted to the handle barrel. U.S. Pat. No. 2,273,632 shows a similar arrangement in which a moveable sleeve presses against and compresses a spring at a predetermined torque to disengage a tooth and notch connection between the handle and sleeve. Similarly, U.S. Pat. No. 3,314,708 includes a pair of opposed ball bearings which are normally biased into driving engagement with a sleeve by a spring-loaded plunger. Upon application of a predetermined torque, the ball bearings displace the plunger against the spring biasing force to disengage the balls from the sleeve.

These prior devices have attempted to solve the problem of preventing damage to handles, doors and door locks caused by excessive handle torque. However, a need exists for a simplified yet durable apparatus having the features of the present invention.

SUMMARY OF THE INVENTION

The present invention is based on a handle to transmit force through a spindle to a door opening mechanism. The handle is provided with a torque-limiting clutch subassembly to protect the handle against damage in the event that excess torque is applied to the handle, particularly, for example, when the door is locked. This object is inventively achieved in accordance with a slip clutch placed in working contact with the spindle within the handle. The slip clutch is provided with at least one notch to normally seat a spindle cross pin such that, upon application of a force, the handle normally rotates with the spindle through the coupling between the notch and the cross pin. However, upon the application of a predetermined force or torque, the cross pin will ride up out of the notch in the slip clutch thereby allowing the handle to rotate without rotating the spindle to prevent damage to the handle, the clutch subassembly, and/or the door opening mechanism.

BRIEF DESCRIPTION OF THE DRAWINGS

The invention and further features and advantages thereof are explained in greater detail on the basis of the exemplary embodiments schematically shown in the figures.

DETAILED DESCRIPTION OF THE PREFERRED EMBODIMENTS

Figure 1:
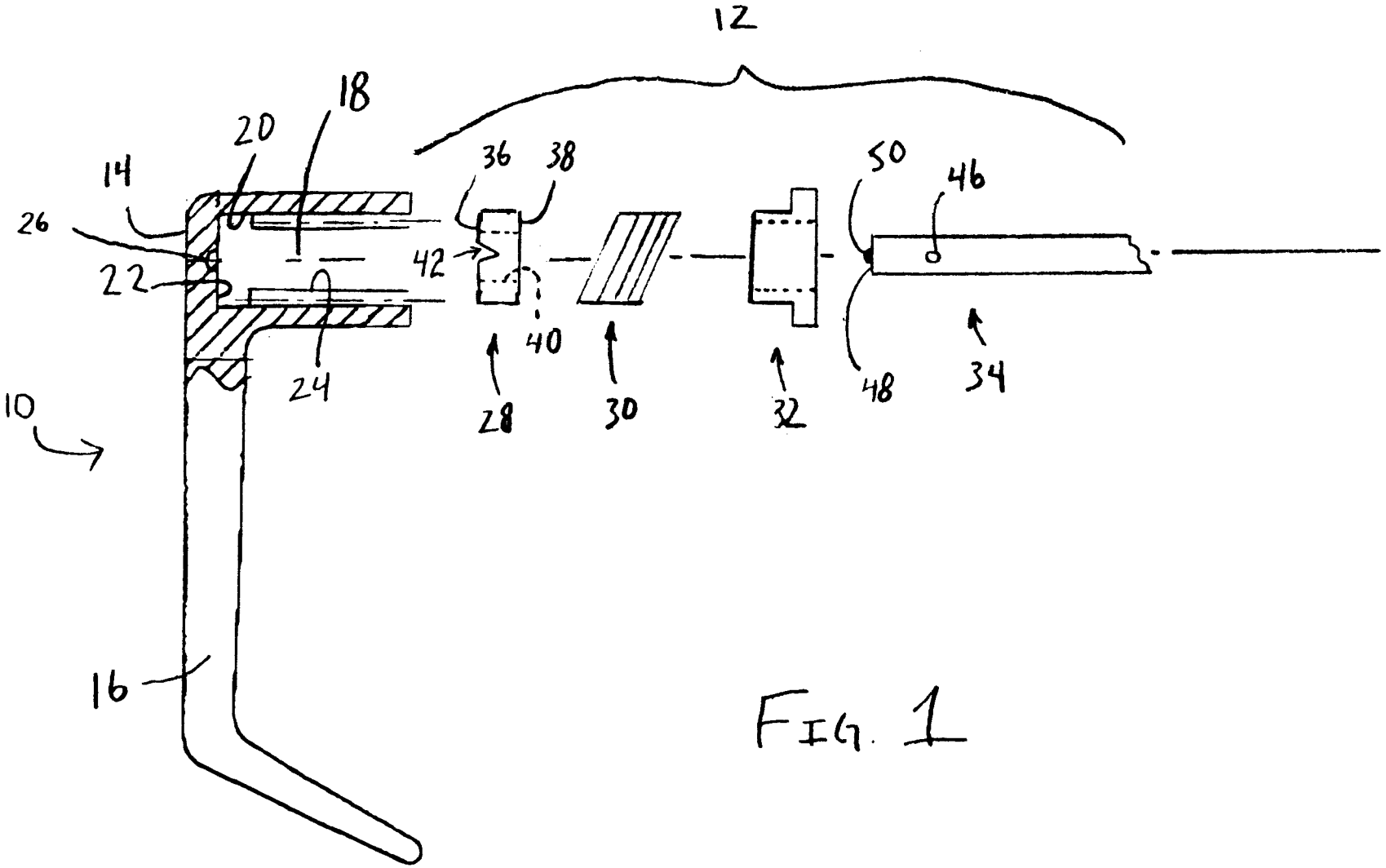
FIG. 1 is a partial sectional view of the inventive clutch handle along the line A—A of FIG. 3 and showing a clutch subassembly thereof in an exploded side elevational view.

While the present invention may be embodied in many different forms, there is shown in the drawings and discussed herein one or more specific embodiments with the understanding that the present disclosure is to be considered only as an exemplification of the principles of the invention and is not intended to limit the invention to the embodiments illustrated.

Figure 2:
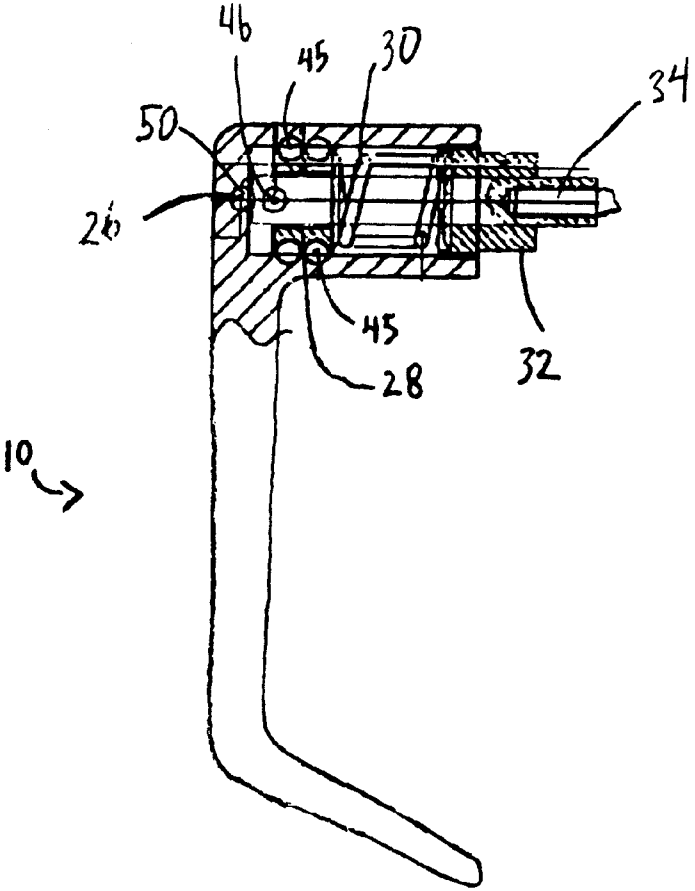
FIG. 2 is a partial sectional, partial elevational, side view of the clutch handle of FIG. 1 but showing the clutch subassembly in an operational configuration within the handle.

Referring to the drawings in more detail, FIG. 1 and FIG. 2 illustrate a rotatable handle 10 housing a torque-limiting clutch subassembly 12 which provides for the selective disengagement of the handle 10 from a door opening mechanism (not shown) at and above a predetermined torque according to an exemplary embodiment of the present invention.

Figure 3:
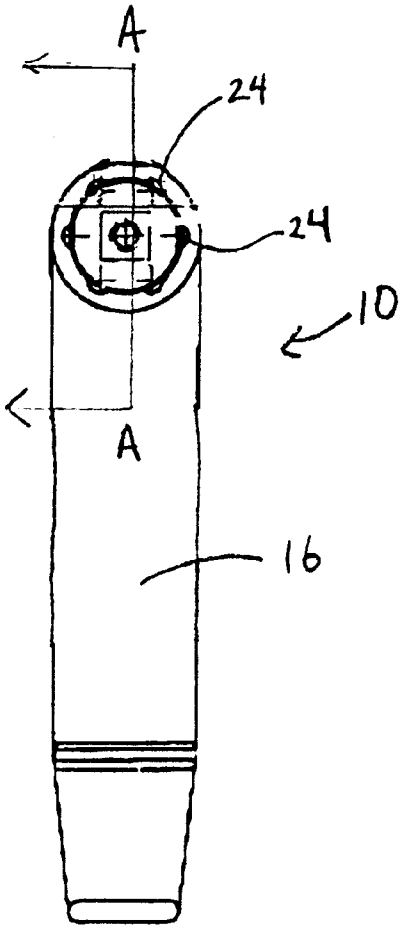
FIG. 3 is front elevational view of the clutch handle.

Referring to FIG. 1 and FIG. 3, the handle 10 comprises a generally cylindrical cap 14 integrally formed with a depending lever arm 16. A blind recess or bore 18 defining a cylindrical inner wall 20 and a circular bearing surface 22 is formed in the cap 14. A plurality of longitudinal grooves 24 (two of which are illustrated in FIG. 1) are symmetrically spaced apart around the circumference of the inner wall 20 (see also FIG. 3). Referring to FIG. 1, a semispherical recess 26 is formed at the center of the bearing surface 22.

Referring now to FIG. 1 and FIG. 2, the clutch subassembly 12 comprises a generally annular slip clutch 28, a biasing helical spring 30, a supportive bushing 32, and a spindle 34 which transmits force, for example by linear displacement, to a door latch mechanism (not shown).

Figure 4C:
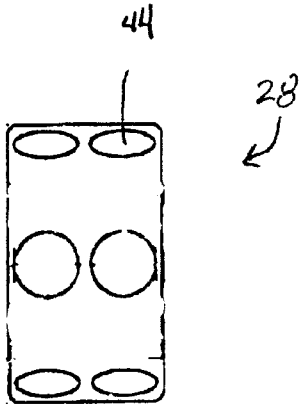
FIG. 4*c* is a side elevational view of the slip clutch of FIG. 4*a*.
Figure 4A:
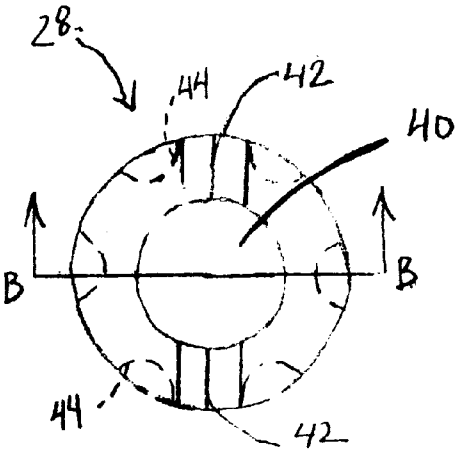
FIG. 4*a* is a perspective view of a slip clutch of the clutch handle.
Figure 4B:
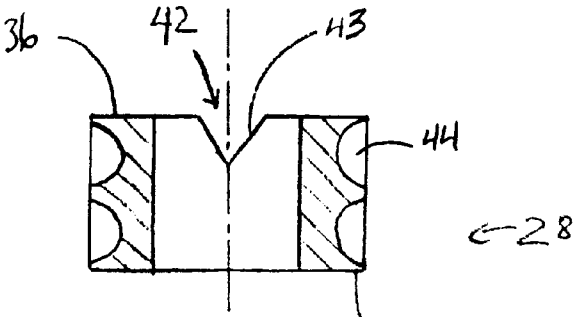
FIG. 4*b* is a sectional elevational view of the slip clutch of FIG. 4*a* taken along line B—B thereof

Referring to FIG. 4*a*, FIG. 4*b* and FIG. 4*c*, the slip clutch 28 includes a face 36, a rear 38, and an axial passage or bore 40. As illustrated in FIG. 4*a* and FIG. 4*b*, a pair of notches 42 spaced 180° apart around the outer circumference of the face 36 define respective pairs of opposed inclined surfaces or ramps 43. Referring to FIGS. 4*a*–4*c*, a plurality of semispherical recesses 44 are symmetrically spaced apart around an outer surface of the slip clutch 28. Referring to FIG. 1 and FIG. 2, the recesses 44 are sized to supportively seat balls 45 which in turn are received by and communicate with the grooves 24 to facilitate back-and-forth longitudinal or axial movement of the slip clutch 28 within the bore 18. As discussed more below, the grooves 24 also limit or preclude rotational movement of the slip clutch 28 with respect to the handle 10 (i.e., the slip clutch 28 rotates with the handle 10).

Referring to FIG. 1 and FIG. 2, the spindle 34 includes a cross pin 46 extending outward from or perpendicular to the spindle 34, the function of which is discussed below, and a spindle end face 48.

FIG. 2 illustrates the clutch subassembly 12 in its operational configuration within the cap 14. As shown in FIG. 2, the spindle 34 extends into the bore 18 with a ball 50 provided between the spindle end face 48 and the recess 26 in the bearing surface 22 to facilitate rotation of the spindle 34 with respect to the handle 10.

As illustrated in FIG. 2, the slip clutch 28, the spring 30 and the bushing 32 slip over the spindle 34 in series in a coaxial alignment. More particularly, referring to FIG. 1 and FIG. 2, the slip clutch 28 is positioned adjacent the bearing surface 22 with each of the grooves 24 supportively receiving corresponding balls 45. In this position, one of the notches 42 is seated against (i.e., firmly engages) the spindle cross pin 46. The biasing spring 30 is fitted over the spindle to abut against the slip clutch rear face 38, and the bushing 32 is threaded or fit into an open end of the cap 14 to engage and bias the spring 30 against the rear 38 of the slip clutch 28.

Referring to FIG. 2, in operation the spring 30 normally biases the slip clutch 28 to seat one of the notches 42 against the pin 46 such that the spindle 34, and handle 10 will rotate with one another through the transmission of force via the coupling between the pin 46 and the notch 42. However, the application of a predetermined amount of torque thorough the handle causes the pin 46 to ride along one of the ramps 44 out of the notch 42, urging the slip clutch 28 against the biasing force of the spring 30 and disengaging the handle 10 from the spindle 34 to allow the handle 10 to rotate without rotating the spindle 34. The handle 10 may be reset by reseating the pin 46 onto the notch 42, whereupon the handle 10 will again be connected to the spindle 34 for co-rotation.

Alternatively, after the pin 46 is unseated from one of the notches 42, it may then be independently rotated 180° with respect to the slip clutch 28 whereupon the pin 46 will become seated within the other of the notches 42 and thereafter provide corotation of the handle 10 and the spindle 34. In other words, upon successive applications of a predetermined amount of torque, the handle 10 can be continuously rotated clockwise, for example, with the pin 46 intermittently engaging each of the notches 42 at 180° intervals.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

What is claimed is:

1. An apparatus for limiting the amount of torque applied to a door or window opening mechanism, comprising:

a handle rotatable about an axis including a handle cap with a bore therein concentric with said axis;

a clutch subassembly, comprising:

a slip clutch mounted to said handle and within said bore, said slip clutch comprising a face having at least one notch formed in said face, said notch including first and second opposed ramps for receiving said pin to form said coupling;

a biasing spring positioned between said slip clutch and a bushing fixed relative to said handle cap; and a spindle positioned within said bore and extending through said slip clutch, said spindle having an outer surface mounting a pin; and said clutch subassembly configured such that said handle transmits force to said spindle through a coupling formed between said slip clutch and said pin upon the application of less than a predetermined amount of torque and said slip clutch disengages said spindle at and above the predetermined amount of torque wherein said slip clutch disengages said spindle by said spring urging said pin along one of said ramps upon the application of said predetermined amount of torque.

2. The apparatus of claim 1, wherein said slip clutch comprises a plurality of notches formed in said face.

3. The apparatus of claim 2, wherein said plurality of notches comprises first and second notches spaced 180° apart around an outer circumference of said face of said slip clutch.

4. The apparatus of claim 1 wherein said bore comprises a blind recess having plurality of longitudinal grooves formed in said handle cap.

5. The apparatus of claim 4, further comprising a plurality of recesses formed in an outer surface of said slip clutch, each said recess corresponding to one of said plurality of grooves such that said slip clutch may be mounted within said cap to allow for longitudinal movement of said slip clutch along said grooves and to prevent independent rotation of said slip clutch within said cap.

6. An apparatus for limiting an amount of torque transmitted between a door or window handle and a handle spindle, comprising:

a handle rotatable about an axis including a handle cap with a bore therein concentric with said axis;

a clutch subassembly mounted within said bore of said handle cap, comprising:

a slip clutch mounted to said handle and within said bore of said handle cap to corotate with said handle, yet free to move axially within said bore to a limited degree, said slip clutch comprising at least one notch therein to receive said spindle projection to provide said coupling;

a biasing spring positioned between said slip clutch and a wall fixed relative to said handle cap; and a spindle positioned within said bore and extending through said slip clutch, said spindle having a projection extending away from said axis to engage with said slip clutch, wherein a coupling is formed between said clip clutch and said projection of said spindle by means of a biasing force provided by said spring to cause said spindle and said handle to corotate upon an application of a torque below a predetermined value on said handle, and wherein said coupling is disengaged against said biasing force of said spring upon an application of a torque at and above said predetermined value.

7. An apparatus according to claim 6, wherein said wall fixed relative to said handle cap comprises a bushing threadingly engagable with said handle cap.

8. An apparatus according to claim 6, wherein said projection comprises a pin projecting perpendicular to said axis.

9. An apparatus according to claim 6, wherein said slip clutch comprises a plurality of notches on a face thereof.

10. An apparatus according to claim 6, wherein said biasing spring comprises a helical spring.

11. An apparatus according to claim 6, wherein said handle includes a lever arm extending from said handle cap radially away from said axis.

12. An apparatus according to claim 6, wherein said slip clutch comprises a plurality of semispherical recesses in an outer surface therein, said bore comprises a plurality of longitudinal grooves therein and a plurality of balls are located in said recesses and grooves to hold said slip clutch rotationally fixed relative to said handle cap.

13. An apparatus according to claim 6, wherein said bore is a blind bore with an inner surface comprising a bearing surface and said slip clutch is biased by said spring towards said bearing surface, and including a friction reducing bearing interposed between said slip clutch and said bearing surface.

14. An apparatus according to claim 13, wherein said bearing comprises a ball bearing.

15. An apparatus for limiting an amount of torque transmitted between a door or window handle and a spindle, comprising:

a handle rotatable about an axis including a handle cap with a blind bore therein concentric with said axis, said handle comprising a lever arm extending from said handle cap radially away from said axis and said bore comprising an inner surface comprising a bearing surface and a plurality of longitudinal grooves formed therein;

a clutch subassembly mounted within said bore of said handle cap, said clutch subassembly comprising:

a slip clutch mounted to said handle and within said bore of said handle cap to corotate with said handle, yet free to move axially within said bore to a limited degree, said slip clutch comprising:

a face having a plurality of notches formed therein, each said notch defining first and second ramped surfaces formed therein, a plurality of semispherical recesses formed in an outer surface therein, a plurality of balls located in said recesses, and grooves to hold said slip clutch rotationally fixed relative to said handle cap;

a biasing spring positioned between said slip clutch and a bushing threadingly engagable with said handle cap; and said spindle positioned within said bore and extending through said slip clutch, said spindle having a pin projecting perpendicular to said axis to engage with said slip clutch, wherein a coupling is formed between said slip clutch and said projection of said spindle by means of a biasing force provided by said spring to bias said slip clutch towards said bearing surface to cause said spindle and said handle to corotate upon an application of a torque below a predetermined value on said handle, and wherein said coupling is disengaged against said biasing force of said spring upon an application of a torque at and above said predetermined value.

16. The apparatus of claim 1, wherein said biasing spring comprises a helical spring.

* * * * *